United States Patent [19]

Justice et al.

[11] Patent Number: 4,687,558

[45] **Date of Patent: * Aug. 18, 1987**

[54] HIGH CURRENT DENSITY CELL

[75] Inventors: David D. Justice; Kenneth E. Woodard, Jr., both of Cleveland, Tenn.

[73] Assignee: Olin Corporation, Cheshire, Conn.

[ * ] Notice: The portion of the term of this patent subsequent to May 13, 2003 has been disclaimed.

[21] Appl. No.: 859,956

[22] Filed: May 5, 1986

Related U.S. Application Data

[63] Continuation-in-part of Ser. No. 626,963, Jul. 2, 1984, Pat. No. 4,588,483.

[51] Int. Cl.[4] ..... C25B 1/34

[52] U.S. Cl. ..... 204/59 R; 204/98; 204/128; 204/252; 204/253; 204/283

[58] Field of Search ..... 204/1 R, 59, 98, 128, 204/252, 253, 257, 258, 282, 283, 290 R, 294

[56] References Cited

U.S. PATENT DOCUMENTS

| | | | |
|---|---|---|---|
| 4,100,036 | 7/1978 | Rode et al. | 204/14 R |
| 4,279,731 | 7/1981 | Pellegri | 204/254 |
| 4,331,521 | 5/1982 | Chisholm et al. | 204/98 |
| 4,340,452 | 7/1982 | deNora | 204/129 |
| 4,341,604 | 7/1982 | DeNora et al. | 204/98 |
| 4,343,689 | 8/1982 | de Nora et al. | 204/253 |
| 4,343,690 | 8/1982 | de Nora | 204/263 |
| 4,381,979 | 5/1983 | deNora et al. | 204/98 |
| 4,389,289 | 6/1983 | deNora | 204/128 |
| 4,389,298 | 6/1983 | Pellegri | 204/288 |
| 4,417,960 | 11/1983 | Pellegri | 204/98 |
| 4,425,214 | 1/1984 | Pellegri | 204/254 |
| 4,444,632 | 4/1984 | deNora | 204/98 |
| 4,526,663 | 7/1985 | Yoshida et al. | 204/98 |
| 4,530,743 | 7/1985 | deNora | 204/98 |
| 4,588,483 | 5/1986 | Woodard, Jr. et al. | 204/59 R |

OTHER PUBLICATIONS

Dr. Dieter Bergner (Hoechst Aktiengesellschaft) Current-Voltage Curves and Coefficient of Resistance in Commercial Chloralkali Electrolysis--Chemiker-Zeitung 198(5), 177-183 (1985), pp. 1-22.

*Primary Examiner*—John F. Niebling
*Assistant Examiner*—Terryence Chapman
*Attorney, Agent, or Firm*—Ralph D'Alessandro; Thomas P. O'Day

[57] ABSTRACT

A filter press membrane electrolytic cell having at least one cathode and one anode sandwiched about a permselective ion exchange membrane which employs a cathode having a first layer and a second layer cooperative with the membrane such that the voltage coefficient during operation at current densities greater than 4.0 kiloamperes per square meter is less than about 0.20 volts per kiloampere per square meter.

28 Claims, 8 Drawing Figures

HIGH CURRENT DENSITY CELL

This is a continuation-in-part application of Ser. No. 626,963, filed July 2, 1984, now U.S. Pat. No. 4,588,483.

BACKGROUND OF THE INVENTION

This invention relates generally to filter press membrane electrolytic cells. More specifically, it relates to the structure and operating conditions which permit a filter press membrane cell to be operated at high current densitites.

Chlorine and caustic, products of the electrolytic process, are basic chemicals which have become large volume commodities in the industralized world today. The overwhelming amounts of these chemicals are produced electrolytically from aqueous solutions of alkali metal chlorides. Cells which have traditionally produced these chemicals have come to be known as chloralkali cells. The chloralkali cells today are generally of two principal types, the deposited asbestos diaphragm-type electrolytic cell or the flowing mercury cathode-type.

Comparatively recent technological advances, such as the development of dimensionally stable anodes and various electrode coating compositions, have permitted the gap between electrodes to be substantially decreased. This has dramatically increased the energy efficiency during the operation of these energy-intensive units.

The development of a hydraulically impermeable membrane has promoted the advent of filter press membrane chloralkali cells which produce a relatively uncontaminated caustic product. This higher purity product obviates the need for caustic purification and reduces the need for concentration processing. Initially the use of a hydraulically impermeable planar membrane has been most common in bipolar filter press membrane electrolytic cells. Some filter press membrane cells, especially in the bipolar electrode design, have attempted to use a dual cathode surface comprising a first layer of coarse supporting mesh to serve as a current distributor and a finer mesh cathode screen on top of the coarse supporting mesh as the second layer. Other cell designs have recognized the need for obtaining uniform current distribution, especially in cells of a monopolar design, but have failed to achieve this for several reasons, for example because of the use in wide, short cells of a bus bar carrying current across the width of a cell, but near the cell bottom, so that the electrode material has to carry the current vertically upwardly in the cell. However, continual advances have been made in the development of monopolar filter press membrane cells.

Despite these continued advances in the filter press cell technology, the high initial capital cost to build an electrolytic cell facility has deterred large scale construction of these type of cells in the industry. Attempts to reduce these high capital costs have recently focused on the ability to operate the cells at elevated current densities to permit fewer cells to be able to produce more product than is conventionally produced at lower current densities in the two to three kiloampere per square meter range. However, such attempts have met with problems because of the heat buildup within the operating cell. This heat buildup results from the resistance that the cell components generate to current flow through the cell. The cell has metal parts such as conductor rods, electrode frames, bus bars, the cathodes and the anodes that contribute to the voltage coefficient resistance, which is the sum of the resistances of the cell components, the membranes and the electrolyte to current flow. Filter press membrane cells, in the past, have had typical hardware or cell component resistances of approximately 250 millivolts at current densities in the 3 kiloampere per square meter range.

As the heat builds within the cell, the electrolyte temperature increases and can even reach the boiling point. This elevated temperature can cause the water to be removed from the cell, such as by evaporation or boiling off, especially in the anolyte, faster than it is replaced. The permselective ion exchange membranes are also affected by this elevated temperature. The polymer chains on current membranes can delaminate from each other because of elevated operating temperatures, which will cause blisters in the membrane. The membranes also can rupture or burst due to the water boiling within the membrane because of the heat generated by the electrical resistance within the membrane. In order for the membrane to function properly, the water must remain in the liquid phase. The elevated temperature and the boiling of the water can cause the membranes to delaminate when a cell is operated at a current density above 4.0 kiloamperes per square meter over a period as short as a few minutes, depending upon cell size.

These problems are solved in the design of the present invention by controlling the voltage coefficient or summation of resistances of the cell, expressed in terms of the current density, below a predetermined level to obtain a heat and material balance which, because of the lower cell resistance, permits the cell to be operated at higher current densities.

SUMMARY OF THE INVENTION

It is an object of the present invention to provide a filter press membrane electrolytic cell that may be operated at current densities greater than about 4.0 kiloamperes per square meter.

It is another object of the present invention to provide a filter press membrane electrolytic cell that employs a cathode that increases the electrical current flow paths between the cathode surface and the membrane.

It is yet another object of the present invention to provide a filter press membrane cell that achieves substantially uniform current distribution and substantially constant vertical electrolyte concentration within each electrode.

It is a feature of the present invention that a dual cathode having a first layer with an active surface and a second layer with a supporting structure is employed.

It is another feature of the present invention that low overvoltage cathodes and surface modified membranes are employed to control the heat balance within the cell.

It is still another feature of the present invention that the cell operating temperature is maintained at or below 98° C. at atmospheric pressure and the total voltage coefficient of the cell is less than about 0.20 volts per kiloampere per square meter.

It is an advantage of the present invention that a heat and material balance is obtained to permit the filter press membrane electrolytic cell to be operated at high current densities.

It is another advantage of the present invention that more product can be produced with a fewer number of cells.

It is another advantage of the present invention utilizing the alternative embodiment of a filter press membrane electrolytic cell with a monopolar plate type of electrode design that the voltage drop and current distribution efficiencies obtained are as close to those obtained in a biopolar filter press membrane cell design as appears to be practically possible.

These and other objects, features and advantages are obtained in a filter press membrane electrolytic cell having at least one cathode and one anode sandwiched about a permselective ion exchange membrane with a modified or treated surface adjacent at least the cathode which, in conjunction with a dual cathode having a first layer with an active surface and a second layer with a supporting structure, permits the cell to be operated at current densities greater than 4.0 kiloamperes per square meter with a voltage coefficient that is less than about 0.20 volts per kiloampere per square meter while maintaining a value for the constant in the cell voltage equation, Vcell=Constant+(Voltage Coefficient)(Current Density), equal to the linear extrapolation to zero current density of the slope of the plot of the total cell voltage versus the current density curve.

BRIEF DESCRIPTION OF THE DRAWINGS

The advantages of this invention will become apparent upon consideration of the following detailed disclosure of the invention, especially when it is taken in conjunction with the accompanied drawings wherein.

DETAILED DESCRIPTION OF THE PREFERRED EMBODIMENT

Figure 3:
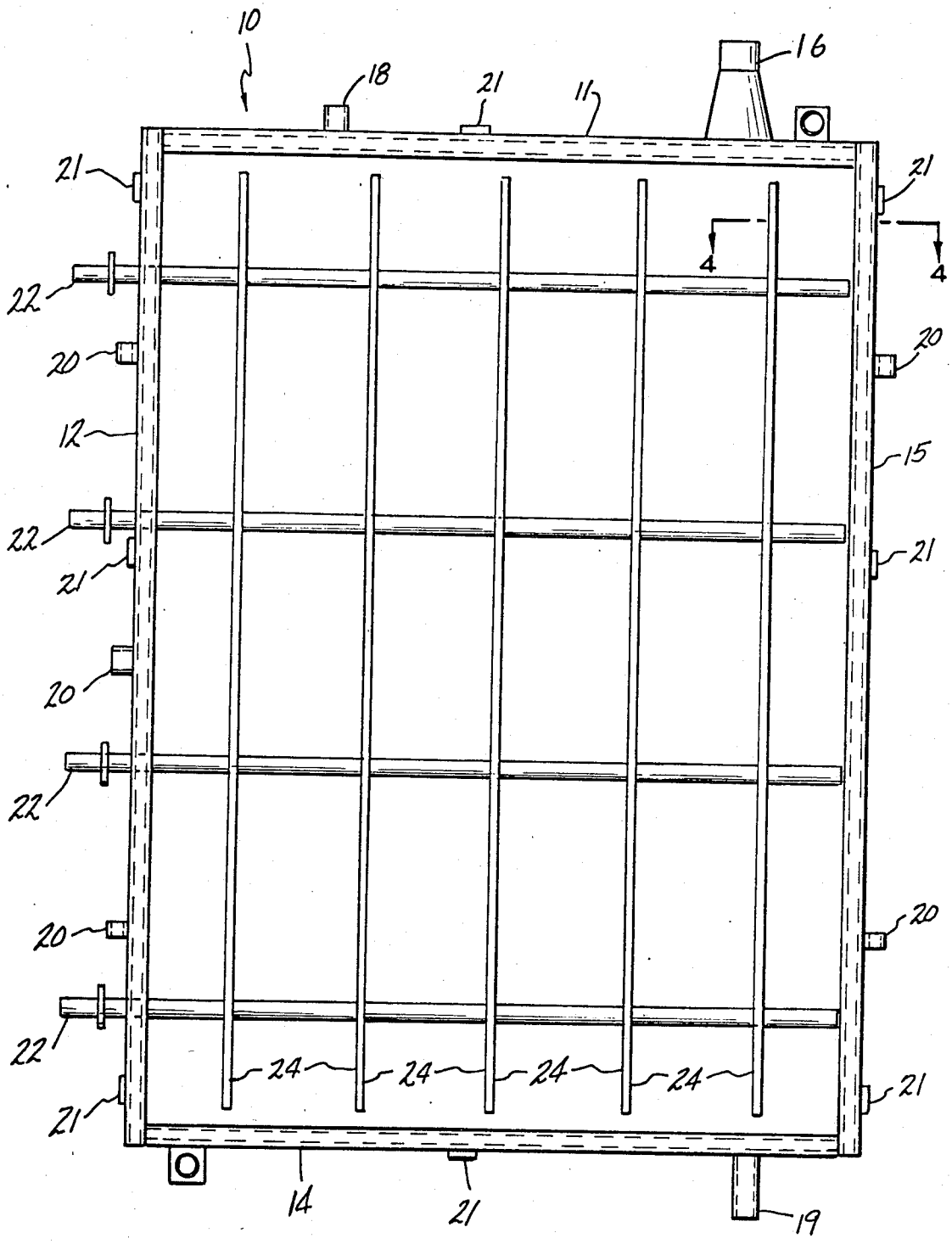
FIG. 3 is a side elevational view of an intermediate cathode with the dual cathode's first and second layers removed.

FIG. 3 shows the structure of a cathode 10 minus the electrode surfaces which may be employed in a cell of the design incorporating the instant invention to achieve operating conditions with current densities in excess of 4.0 kiloamperes per square meter employing surface treated or modified ion selective membranes in a filter press cell type of configuration. The cathode 10 has a frame that is comprised of components 11, 12, 14 and 15. Frame components 12 and 15 extend generally vertically and are parallelly spaced apart during operation of the cell. Frame components 11 and 14 are positioned generally horizontally during the cell operation.

The top frame component 11 is seen as having a sample port 18 and a cathode riser 16 projecting from the top thereof. An anode (not shown) may have a corresponding riser and sample port to permit fluid flow between the appropriate gas-liquid disengager (not shown) and the corresponding electrode. The risers are generally utilized to carry the appropriate electrolyte fluid with the accompanying gas, either anolyte with chlorine gas or catholyte with hydrogen gas, to the appropriate disengager (not shown) mounted on top of a filter press membrane cell. External circulation is employed to circulate electrolyte from the appropriate disengager through infeed manifolds (not shown) back into the electrodes through infeed pipes.

The bottom frame component 14 is shown having a catholyte infeed pipe 19 that extends upwardly through the bottom into the interior of the cathode formed between the opposing electrode surfaces. The catholyte infeed pipe 19, as well as the corresponding anolyte infeed pipe (not shown), are connected to infeed manifolds (also not shown) to permit the anolyte and catholyte fluids to be fed upwardly through the bottom of the appropriate electrode frames.

A series of lifting lugs 20 are spaced about the exterior of the frame components 11, 12, 14 and 15. These lifting lugs 20 permit the cathode 10 to be easily lifted into position for assembly. A similar structure can be found on the anode frames (not shown).

Similarly, a series of spacer blocks 21 are positioned about the exterior of the frame components 11, 12, 14 and 15. These spacer blocks 21 are positioned so that they are opposite and adjacent corresponding spacer blocks on the adjacent anode (not shown) so that spacers may be placed between the pairs of spacer blocks to assure the proper interelectrode gap is obtained uniformly about the assembled cell in a manner that is well known in the art.

The cathode 10 is seen as having conductor rods 22 extending generally horizontally through one of the generally vertically extending frame components, in this case frame component 12. Appropriately fastened, such as by welding, to each of the conductor rods 22 are a plurality of vertically extending current distributor ribs 24 which are spaced generally equally across the width of the cathode to permit uniform distribution of the current. The conductor rods 22, similarly, are generally equally distributed across the vertical height of the cathode 10 to permit the current to be introduced generally uniformly across the full height of the cathode 10.

Figure 4:
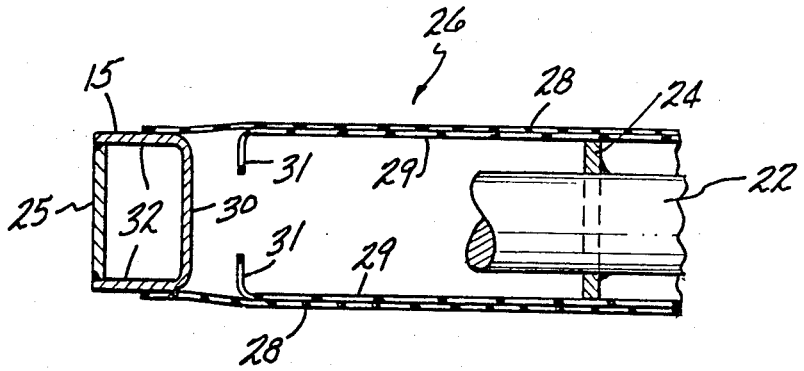
FIG. 4 is an enlarged, partial sectional view taken along the lines 4—4 of FIG. 3 with the dual cathode layers shown and a conductor rod partially shown.

As seen in FIG. 4, each of the frame components, such as frame component 15 is generally U-shaped with a covering plate 25 covering the top of the U. The dual cathode, indicated generally by the numeral 26, is seen as comprising a first layer 28 and a second layer 29 on both sides of the cathode 10. The first layer 28 is the primary active surface and is a foraminous metal structure, preferably a mesh formed of expanded metal. The second layer 29 is a foraminous metal supporting layer, also preferably a mesh formed of expanded metal, with larger openings than in the first layer 28 to promote the passage of the electrolytically generated gas bubbles therethrough. The openings in the second layer 29 optimally are four times the size of the openings in the first layer 28 with the primary active surface.

Second layer 29 is preferably fastened to the current distributor ribs 24, such as by welding. The current distributor ribs 24 (only one of which is shown in FIG. 4) are fastened, as described above, to the conductor rods 22 (only one of which is partially shown). The second layer 29 is seen as being curved inwardly toward the center of the cathode 10 interiorly of the inner wall or base 30 of the U-shaped frame component 15.

The first layer 28 of the cathode is shown as extending over the space between this inwardly curved portion 31 of the second layer 29 and the base 30 of the frame component 15. Thus, the second layer 29 does not contact any of the frame components 11, 12, 14 or 15. The first layer 28 may be fastened, such as by spot welding, to the leg portions 32 of the U-shaped frame components. The membrane, not shown in FIG. 4, is then placed adjacent the first layer 28 on both sides of the cathodes between the adjacent anodes to form a cathode-membrane-anode sandwich.

The anodes employed in a cell of the design incorporating the present invention (not shown) may be similar to the cathode 10 design, employing either a dual layer active surface or a single layer active surface.

It should be noted that both electrodes, the cathode 10 and the anode (not shown), are of the low overvoltage type. That is, in an effort to reduce the working voltage of an electrolytic cell and, specifically, the overvoltage at both the anode and the cathode, low overvoltage cathodes and anodes are employed for the active surfaces. The cathode or the anode may comprise a solid or perforated plate, a rod, a foraminous structure or a mesh of any shape. While the preferred cathode structure has been described as being a mesh, it could equally well be a reticulate mat as long as a supporting structure of some type is employed. Such a reticulate mat can be made from a cathode substrate comprised of a conductive metal, such as copper or nickel, plated with an intermediate coating of a porous dendritic metal and an outer coating of a low overvoltage material, such as Raney nickel or other appropriate alloy. The anode may be formed from a suitable valve metal, such as titanium or tantalum, which has a suitable coating with low overvoltage characteristics, such as ruthenium oxide, platinum or other coatings from the platinum group metals, a platinum group metal oxide, an alloy of a platinum group metal, or a mixture thereof. The term platinum group metal as used herein means an element from the group consisting of ruthenium, rhodium, palladium, osmium, iridium and platinum.

Figure 5:
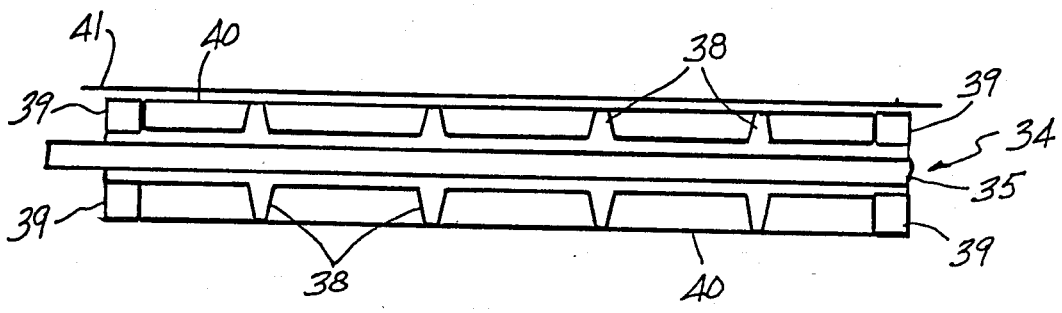
FIG. 5 is a diagrammatic illustration of a plate type of cathode that may be employed as an alternative embodiment.

An alternative embodiment of the cathode structure is shown in FIG. 5 wherein a cathode, indicated generally by the numeral 34 is seen comprising a copper plate 35, a separator plate 36 with vertically extending hollow risers 38 and generally rectangularly shaped frame components 39. A mesh or first layer 40 is placed atop the supporting layer formed by the separator plate 36 with its riser 38. Alternately, a supporting mesh second layer (not shown) can be placed over the risers 38 between the risers 38 and the first layer 40. A surface treated or surface modified mambrane 41, only one of which is shown, is then placed against each of the active surface layers 40. A rib type of structure, instead of hollow riser, could equally well be employed similar in structure to the ribs 24 of FIG. 3.

In the alternative embodiment, the cathode mesh is preferably 0.025 inches thick and formed of a Raney nickel-molybdenum alloy, nickel or codeposited Raney nickel on nickel with three millimeter by six millimeter openings. The thickness could be as low as 0.01 inches thick. The mesh support structure should be thicker, formed from a nickel construction with a thickness of about 0.035 to about 0.045 inches with about 0.5 inch by about 1.25 inch openings. It is feasible, however, to use a mesh support structure that is as thin as about 0.15 inches and still retain sufficient mechanical elasticity properties that are required with the compression forces applied during cell assembly. The first layer 40 in this design is welded to the risers 38 or to other suitable supporting structure, such as the mesh support structure. Where a cathode mesh of thinner proportion is employed the first layer 40 is maintained in contact with the reiser 38 or other suitable supporting structure by pressure and no welding is employed.

The anode (not shown) preferably is of similar structure but would employ titanium in the separator plate in combination with a titanium mesh first layer with the same thicknesses and openings or slightly thicker with larger mesh openings and the mesh layer is welded to the risers.

An appropriate surface modified or surface treated memberane may be selected from those available under the Nafion trademark or the Flemion trademark employing a tin oxide, titanium oxide, tantalum oxide, silicon oxide, zirconium oxide or an iron oxide, such as $Fe_2O_3$or $Fe_2O_4$, coating on the anode and the cathode sides. Alloys of these elements, as well as hydroxides, nitrides or carbide powders could also be employed. Additional elements suitable for forming a porous layer on the cathode side are silver, stainless steel and carbon. This surface treatment provides a and liquid permeable porous non-electrode layer that reduces the buildup of gas bubbles, such as hydrogen the cathode side and chlorine on the anode side, by changing the nature of the membrane's treated surface from hydrophobic to hydrophilic to promote the gas release properties of the membrane.

The membrane can be positioned from the adjacent electrode active surfaces by either a finite gap or by no gap, commonly known as zero gap. However the greater the gap or distance between the membrane and the electrode surface, such as the cathode, the greater is the voltage drop between the electrode surface and the membrane because the current must pass through more of the separating electrolyte. As current densities increase this voltage drop correspondingly increases. For example, with a two millimeter gap between the cathode and a surface modified membrane, such as a Flemion® 755 or 757 or 775 membrane, at 3.0 kiloamperes per square meter current density a 0.065 volt drop was recorded. At 4.5 kiloamperes per square meter the drop was 0.095 volts; at 6.0 kiloamperes per square meter the drop was 0.216 volts. Thus, at higher current densities the voltage drop increases across a gap. At corresponding amperage values in an equivalent cell operated with a zero gap, the voltage drop between this cathode and the membrane was zero or negligible, at least being below the recordable tolerances of the measuring apparatus.

The current that flows through a filter press membrane electrolytic cell causes a voltage as it passes through each component of the cell. The total cell voltage, then, is the sum of the minimum voltage to initiate the electrolytic reaction, the voltage at the membrane/electrolyte surface junctions, the anode overvoltage, the voltage of the anolyte, the voltages of the membrane, the voltage of the catholyte, the cathode overvoltage and the voltage of the cell hardware. The voltage at the membrane/electrolyte surface junctions and the minimum voltage to initiate the reaction are independent of the current density and may be expressed as constants. The other voltage components increase with increasing current density, thereby increasing the heat generated within the cell due to the increased product of current and resistance.

To be able to operate at high current densities the increase of voltage and current density must be maintained in a linear relationship with a voltage coefficient that is less than or equal to about 0.20 volts per kiloampere per square meter so that the increase in voltage is controlled with respect to the current density. This relationship may be expressed as an equation, Vcell = Constant + (Voltage Coefficient) (Current Density).

The constant in the equation is equal to the sum of the minimum voltage to initiate the reaction and the membrane/electrolyte surface junction voltage. This constant is the intercept on the voltage axis of the cell voltage versus current density plot and is graphically obtained by extrapolating back to zero current density the linear plot of the cell voltage versus the current density. The voltage coefficient previously has been described as representing the sum of the resistances of the cell components, the membranes and the electrolyte to current flow. Graphically, the voltage coefficient is equal to the slope of the plot of the total cell voltage versus the current density.

In commercial electrolyzers, however, the constant in the cell voltage equation is not taken to be equal to the theoretical decomposition potential of the following reactions:

$$2Clhu \longrightarrow Cl_2 + 2e; \text{ and}$$

$$2H_2O + 2e \rightarrow 2OH^- + H_2.$$

This calculated decomposition potential will vary depending upon the temperature at which the reactions occur, and the concentrations and pressures of the reactants and products. Such calculated values can range from 2.15 to 2.30 volts.

The decomposition potential can be calculated from the equation $$-\Delta G_o = n\,F\,E_o$$

where $\Delta G_o$ is defined as the total change in chemical potentials of the reactants and products involved in the accompanying reaction in the cell, n is the number of electrons transferred per mole of ions involved, F is the Faraday constant and $E_o$ is the electrical potential in the reaction.

Figure 1:
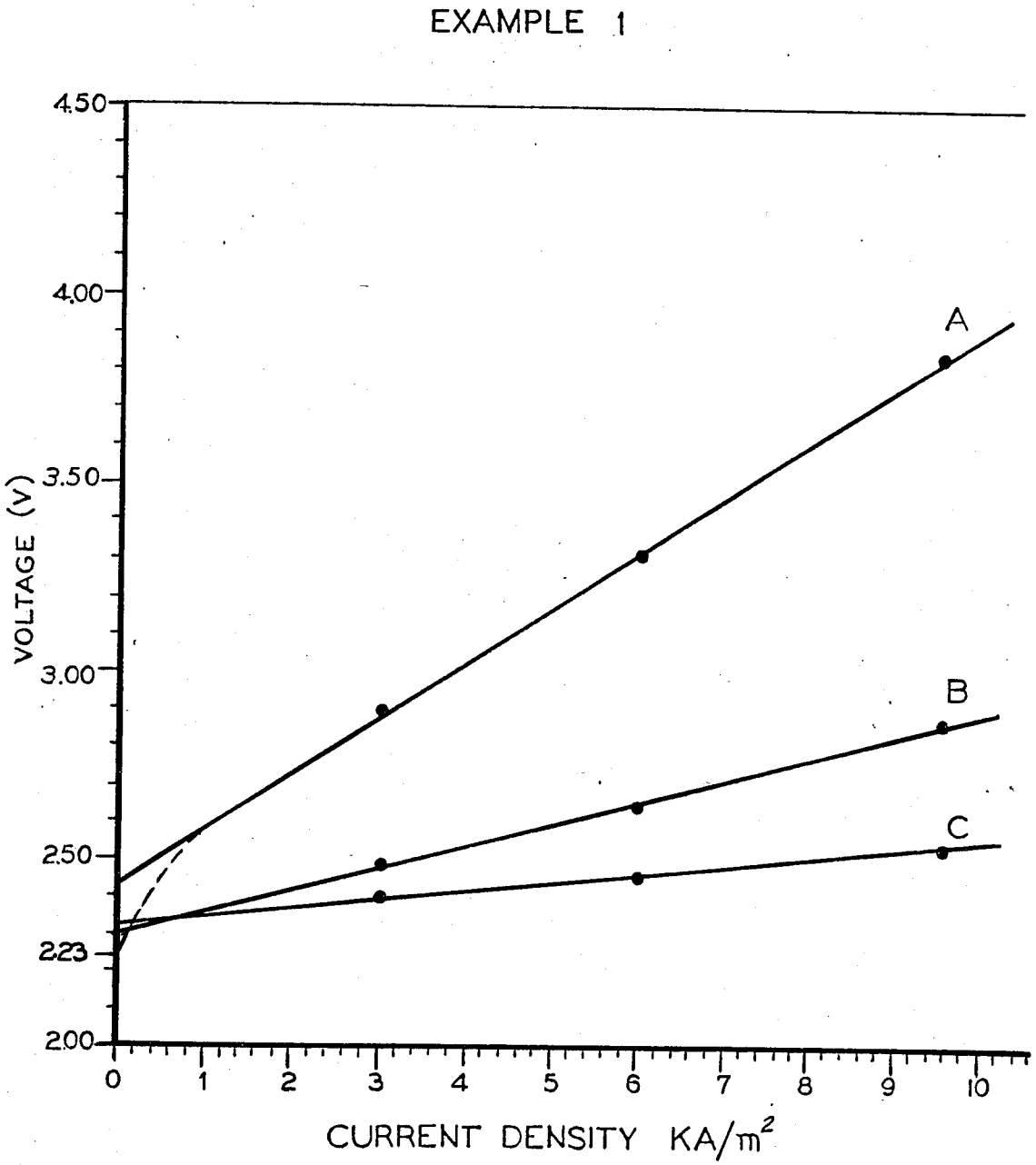
FIG. 1 is a graphic plotting of the voltage versus the current density showing the total cell voltage plot, the slope of which equals the voltage coefficient of the cell above a 3.0 kiloampere per square meter current density.
Figure 2:
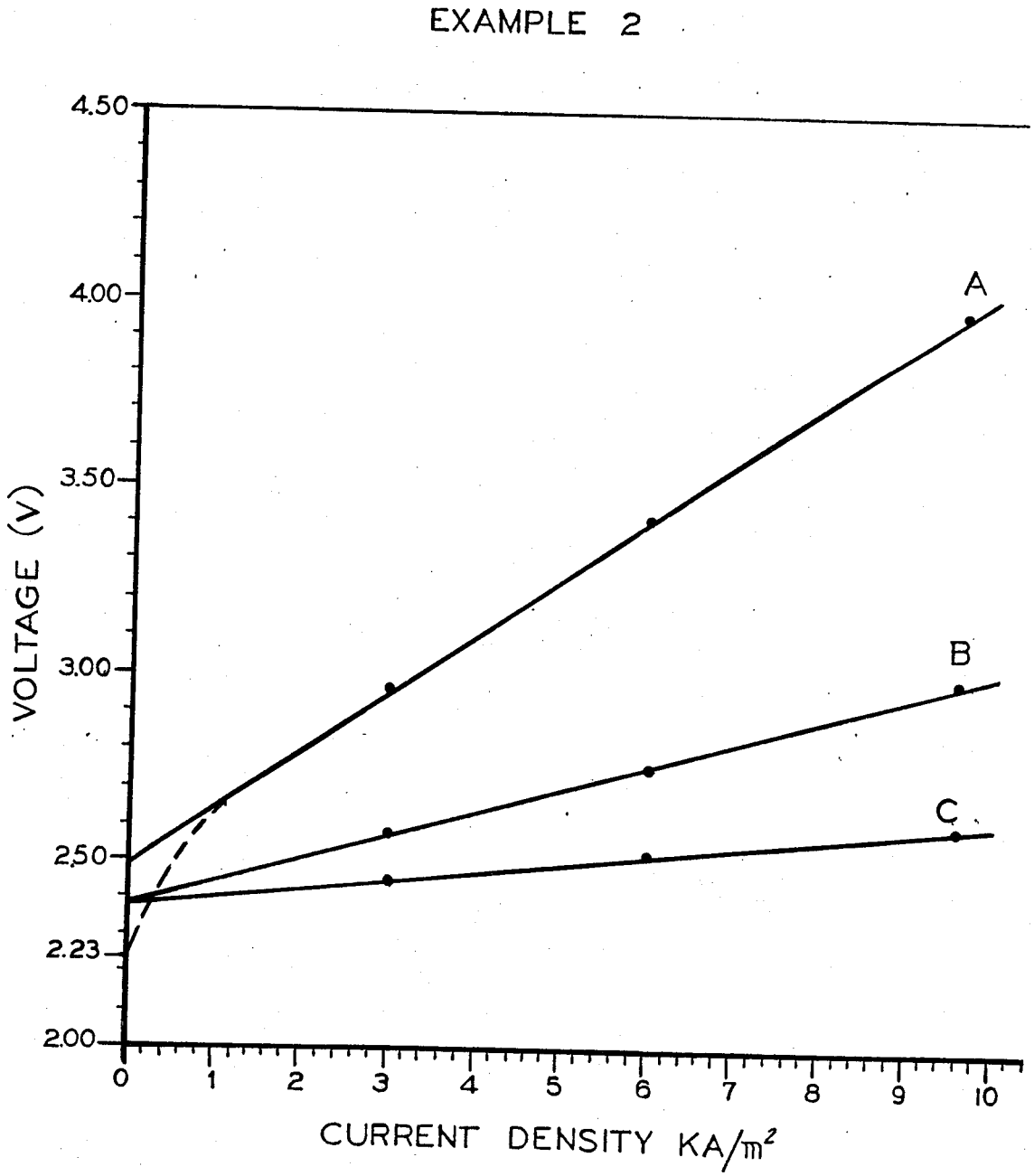
FIG. 2 is a graphic plotting of a second case of the voltage versus the current density showing the total cell voltage plot, the slope of which equals the voltage coefficient of the cell above a 3.0 kiloampere per square meter current density.
Figure 6:
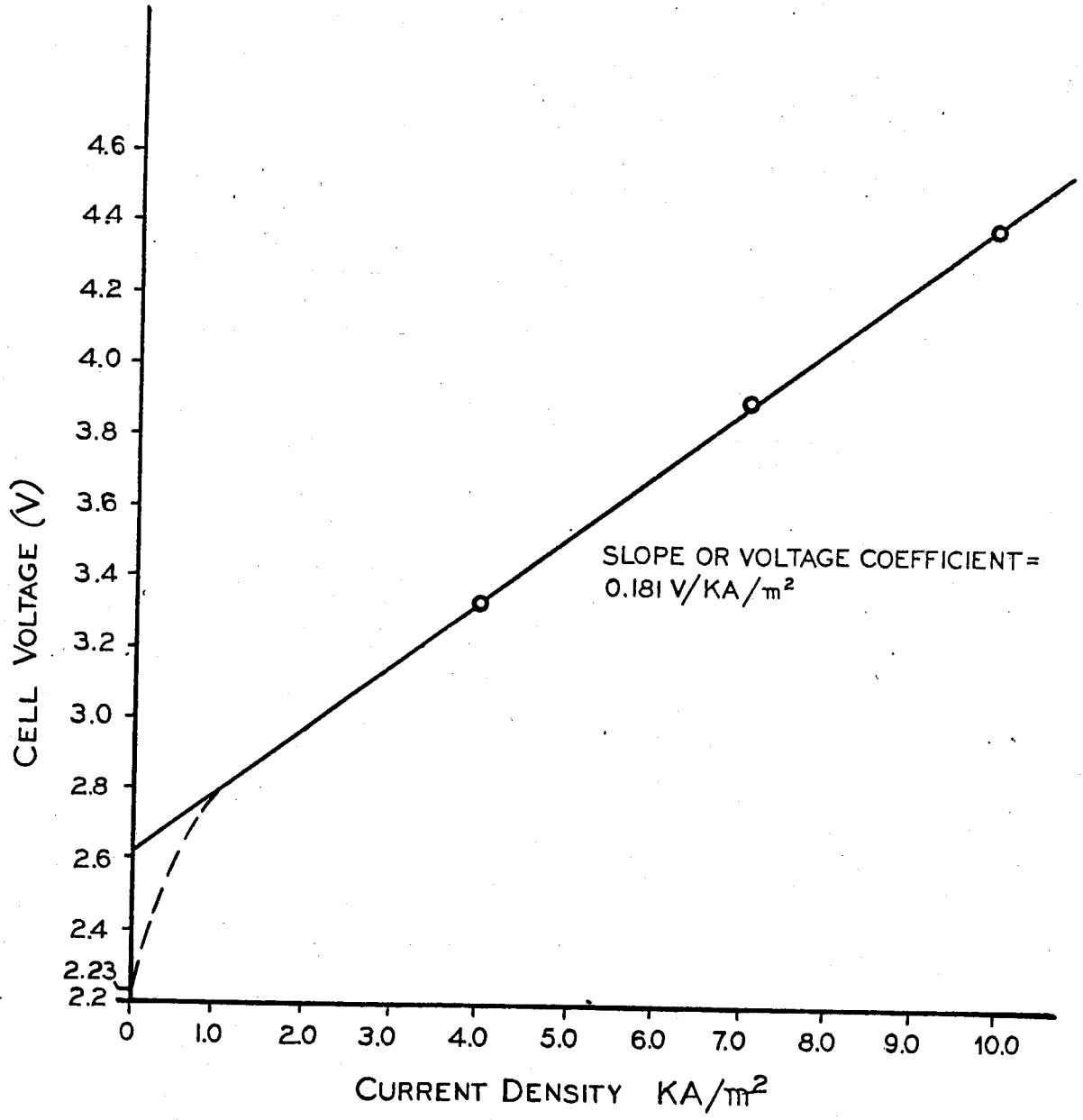
FIG. 6 is a graphic plotting of the cell voltage versus the current density showing the voltage coefficiency for a cell of the alternative embodiment that is operated at a current density of up to about 10 kiloamperes per square meter.

At current densities below 1.0 KA/m$^2$, the relationship between the total cell voltage and the current density becomes non-linear. The total cell voltage drops non-linearly to the decomposition potential at zero current density. This decomposition potential at the cell operating conditions for FIGS. 1, 2 and 6 is about 2.23 volts. The non-linear portion of the total cell voltage versus current density curves is shown by the dotted lines in FIGS. 1, 2 and 6. While not shown graphically, the anode and cathode voltages are similarly non-linear at current densities below 1.0 KA/m$^2$.

The following examples will illustrate how an electrolytic cell employing a permselective membrane can operate at high current densities, such as up to 10 kiloamperes per square meter, if the voltage coefficient is kept below about 0.20 volts per kiloampere per square meter.

As previously mentioned heat is generated as current (I) flows through the resistance (R) in the cell and can be measured as a voltage. Heat generation (IR) will increase with an increase in either resistance or current density. This heat must be compatible with the overall energy and material balance in the operating cell. This IR heat can increase the temperature of the anolyte and catholyte fluids or can boil off water from the anolyte and catholyte fluids if the temperature increase is sufficient.

As the voltage coefficient in an operating cell increases above about 0.20 volts per kiloampere per square meter at a high current density, for example 10 kiloamperes per square meter, the two most important energy and material balance factors controlling cell operation appear to be the increase in temperature for the chlorine gas/anolyte flow streams and the increase in steam content in or with the chlorine gas.

Operation of a cell at higher current densities is generally obtained by a gradual buildup of the current density. This typically is obtained through the use of a cell jumper switch that allows stepwise increases in the current density. For example, the current density can be increased at ½ kiloampere per square meter increments every thirty seconds until the desired current density is obtained.

EXAMPLES

The following examples are presented without any intent to limit the scope of the invention while illustrating the operation of a filter press membrane cell at a high current density greater than about 4.0 kiloamperes per square meter of electrode surface per electrode with a voltage coefficient of less than about 0.20 volts per kiloampere per square meter of electrode surface per electrode.

EXAMPLE 1

A monopolar filter press membrane cell for the production of chlorine and caustic was operated with one cathode and one anode, both of the low overvoltage type. The cathode employed the dual layer design with the first layer or primary active surface being Raney-nickel-12% molybdenum and the second or supporting layer being nickel-200 mesh. The anode was a pH stabilized Conradty anode. A Nafion® brand DuPont membrane with a modified or treated surface was positioned between the cathode and anode surface with no electrolyte gap therebetween. Each electrode and the membrane had 500 square centimeters of active surface area.

The cell was operated with approximately 200 grams per liter of anolyte concentration at 90° C. to produce caustic with a concentration of about 32.5%. The current to the cell was incremented gradually from startup until operation at a current density of 9.5 kiloamperes per square meter was obtained. Average voltage readings are shown in the following table with a standard deviation to reflect voltage fluctuations that occurred during operation. The cell was operated at one atmosphere.

A shutdown of the cell occurred after 47 days of operation, after which the cell was restarted and operated for an additional 14 days. However, some unknown abnormal event occurred during the shutdown and/or startup procedure which adversely affected the cell voltage. For the 23 days of operation of the cell at 9.5 kiloamperes per square meter prior to the shutdown, the average anode voltage was about 0.34 volts and the average cathode voltage was about 0.22 volts.

| CURRENT DENSITY ($KA/m^2$) | VOLTAGE (VOLTS) | CURRENT EFFICIENCY % | DAYS OF OPERATION |
|---|---|---|---|
| 3 | 2.89 ± 0.01 | 96.53 | 3 |
| 6 | 3.31 ± 0.03 | 93.66 ± 0.92 | 21 |
| 9.5 | 3.83 ± 0.04 | 89.01 ± 1.13 | 23 |
| 9.5 | 3.89 ± 0.07 | 88.48 ± 0.88 | 47 |

The hydrogen overvoltage at the low overvoltage cathode for 23 days of operation at 9.5 $KA/m^2$ during the first 46 days of operation prior to the cell shutdown was measured as an average of about 0.22 volts. The chlorine overvoltage at the low overvoltage anode for the same period was measured as an average of about 0.34 volts. Operation of the cell at 9.5 $KA/m^2$ did not have the hydrogen overvoltage at the cathode exceed about 0.30 volts nor the chlorine overvoltage at the anode exceed about 0.40 volts. The second set of values at 9.5 $KA/m^2$ represent the average of the values obtained for the total of the 47 days the cell was operated at 9.5 $KA/m^2$, including 14 days of operation after the temporary cell shutdown.

The graphic plotting in FIG. 1 is the result of the plotting of the individual daily data used to compile the above summary table. The plot labelled A is the total cell voltage versus the current density, while plot B represents the anode and cathode voltage contribution combined and plot C represents just the cathode plot. Both plots B and C include the minimum reaction voltage and the membrane/electrolyte junction voltage. The slope of plot A then represents the voltage coefficient for the cell which calculates to 0.145 volts per kiloampere per square meter and is based upon a linear extrapolation to zero current density from current densities above 1.0 $KA/m^2$.

EXAMPLE 2

A monopolar filter press membrane cell for the production of chlorine and caustic was operated with one cathode and one anode, both of the low overvoltage type. The cathode employed the dual layer design with the first layer or primary active surface being lanthanum-containing layer on nickel and the second or supporting layer being nickel-200 mesh. The anode was a DSA® Eltech Corporation anode. A Flemion® brand Asahi Glass membrane with a modified or treated surface was positioned between the cathode and anode surface with no electrolyte gap therebetween. Each electrode and the membrane had 500 square centimeters of active surface area.

The cell was operated with approximately 200 grams per liter of anolyte concentration at 90° C. to produce caustic with a concentration of about 35.5%. The current to the cell was incremented gradually from startup until operation at a current density of 9.5 kiloamperes per square meter was obtained. Average voltage readings are shown in the following table with a standard deviation to reflect voltage fluctuations that occurred. The cell was operated at one atmosphere.

| CURRENT DENSITY ($KA/m^2$) | VOLTAGE (VOLTS) | CURRENT EFFICIENCY % | DAYS OF OPERATION |
|---|---|---|---|
| 3 | 2.96 ± .04 | 95.37 ± .96 | 23 |
| 6 | 3.40 ± .04 | 93.92 ± .78 | 21 |
| 9.5 | 3.98 ± .02 | 92.76 ± .96 | 17 |

The hydrogen overvoltage at the low overvoltage cathode for the total days of operation was measured as an average of about 0.30 volts and the chlorine overvoltage at the low overvoltage anode for the same period was measured as an average of about 0.38 volts. Operation of the cell at 9.5 $KA/m^2$ did not have the hydrogen overvoltage at the cathode exceed about 0.31 volts nor the chlorine overvoltage at the anode exceed about 0.40 volts.

The graphic plotting in FIG. 2 is the result of the plotting of the individual daily data used to compile the above summary table. The plot labelled A is the total cell voltage versus the current density, while plot B represents the anode and cathode voltage contribution combined and plot C represents just the cathode plot. Both plots B and C include the minimum reaction voltage and the membrane/electrolyte junction voltage. The slope of plot A then represents the voltage coefficient for the cell which calculates to 0.157 volts per kiloampere per square meter and is based upon a linear extrapolation to zero current density from current densities above 1.0 $KA/m^2$.

EXAMPLE 3

A filter press membrane cell of the alternative embodiment with one plate cathode and one plate anode was operated with a Nafion® brand DuPont membrane. The anode was DSA® anode from Eltech Corporation with 1.5 square meters of surface area. The dual cathode had an active surface of Raney-nickel-12% molybdenum in the first layer or primary active surface and a second or supporting layer of nickel-200 mesh. The membrane and cathode both had 1.5 meters of active surface area. There was no electrolyte gap between the anode, membrane and cathode.

The cell was operated with approximately 230 grams per liter of anolyte concentration at current densities of about 4.0, 7.1 and 9.9 kiloamperes per square meter ($KA/m^2$). At 4.0 $KA/m^2$ the operating temperature for 2 days averaged about 77° C. At about 7.1 $KA/m^2$ the operating temperature for 20 days averaged about 90° C. with an average caustic concentration of about 32.35%. At about 9.9 $KA/m^2$ the operating temperature for 9 days averaged about 92° C. with an average caustic concentration of about 32.52%.

| CURRENT DENSITY ($KA/m^2$) | VOLTAGE (VOLTS) | CURRENT EFFICIENCY % | DAYS OF OPERATION |
|---|---|---|---|
| 4.0 | 3.33 ± .02 | — | 2 |
| 7.1/7.2 | 3.91 ± .02 | 90.05 ± .67 | 17 |
| 9.9 | 4.40 ± .01 | 90.03 ± .96 | 3 |

The graphic plotting in FIG. 6 uses the Constant in the cell voltage equation equal to the linear extrapolation to zero current density of the slope of the total cell voltage plot from current densities above 1.0 $KA/m^2$ and reveals the averages shown above for the data readings taken over the number of days indicated. Multiple readings were taken on each day with the exception of the first day of operation. The voltage coefficient was 0.181 volts per kiloampere per square meter and illustrates that by maintaining the voltage coefficient at this level a monopolar filter press cell can operate at high current densities.

Figure 7:
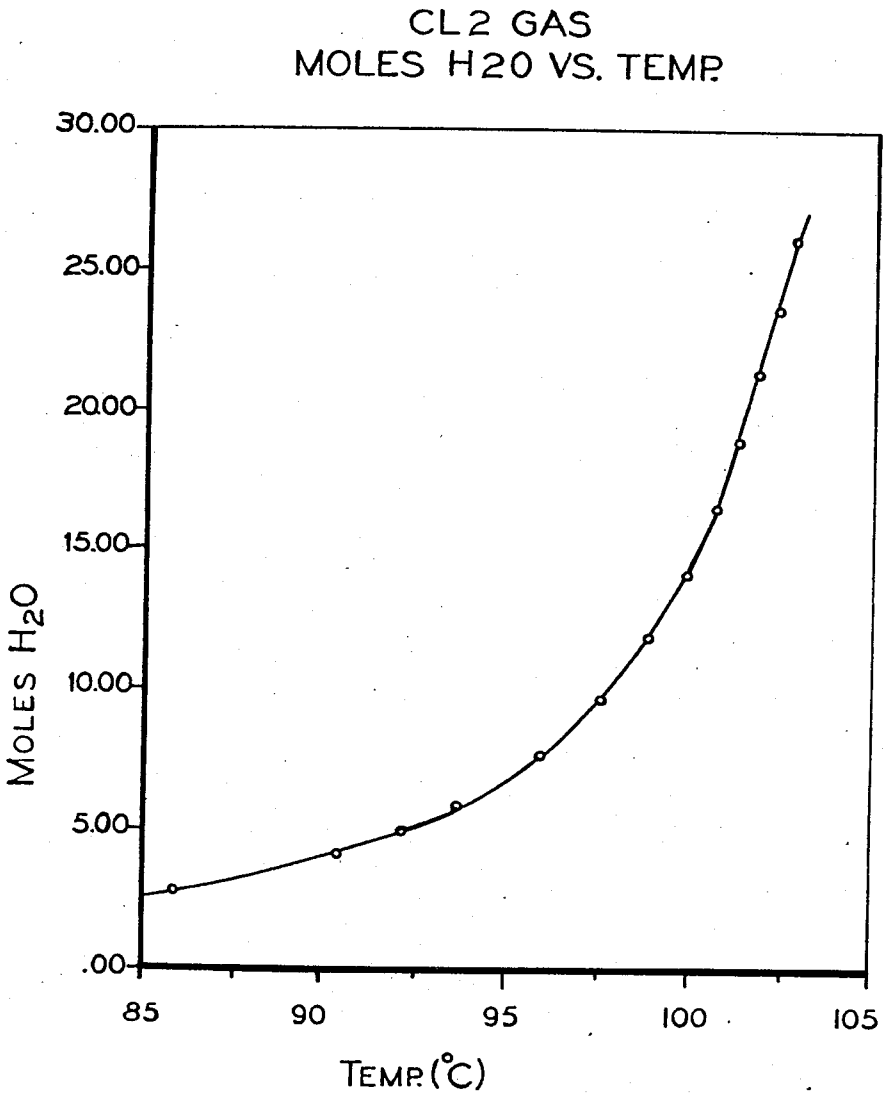
FIG. 7 is a graphic plotting of the moles of water lost through evaporation in a cell versus the temperature of the cell chlorine gas/anolyte flow streams.
Figure 8:
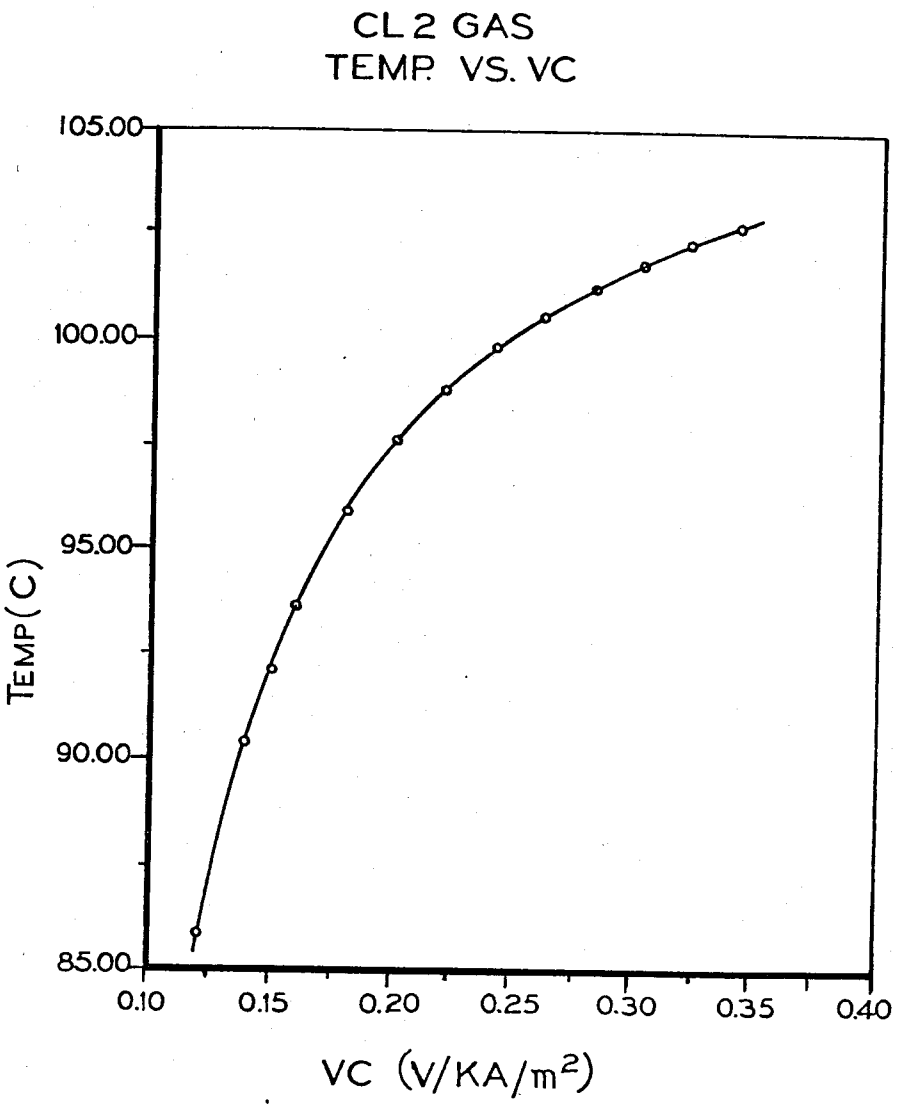
FIG. 8 is a graphic plotting of the chlorine gas temperature versus the voltage coefficient for a monopolar filter press membrane cell operated at high current densities.

The current efficiency was not calculated for the first two days of operation. The cell was operated for 19 additional days at a current density that fluctuated between 9.9 and 10.0 $KA/m^2$ after the 3 days for which data were averaged at 9.9 $KA/m^2$ to form the plot shown in FIG. 6. The data for these days also conforms to the plot shown in FIG. 6 so that the voltage coefficient is substantially unchanged. FIGS. 7 and 8 illustrate the effect of an increase in cell operating temperature on the moles of water lost due to evaporation from the chlorine gas/anolyte flow streams and the effect on the cell operating temperature by the increase in cell voltage coefficient from 0.12 to 0.34 volts per kiloampere per square meter in a filter press membrane cell. These figures illustrate the importance of keeping the voltage coefficient below about 0.20 volts per kiloampere per square meter to maintain the cell operating temperature below about 98° C. and preferably below about 95° C. These graphs are based upon a cell with 15 square meters of membrane and anode and cathode surface area each operated at 95% current efficiency with a 10.0 kiloampere per square meter current density and a total cell load of 150 kiloamperes. The brine feed rate was 10.75 gallons per minute with an inlet brine temperature of 30° C.

Reviewing the data and graphical plots of Examples 1–3 will reveal the relationship between the theoretical decomposition potential and actual potential in electrolyzers where the voltage coefficient is kept below about 0.20 volts per kiloampere per square meter ($KA/m_2$).

The total cell potential versus current density plot or curve A in Example 1, shows that the cell voltage points lie on a straight line which, when extrapolated to zero current density, has an intercept on the cell voltage axis of 2.451 volts. The linear equation for the cell voltage of this straight line plot is $2.451+0.145\ i$, where i is the current density expressed in $KA/m^2$. The slope or voltage coefficient is 0.145 volts/$KA/m^2$.

The total cell potential versus current density plot or curve A in Example 2, shows that the cell voltage points lie on a straight line which, when extrapolated to zero current density, has an intercept on the cell voltage axis of 2.477 volts. The linear equation for the cell voltage of this straight line plot is $2.477+0.157\ i$, where i is the current density expressed in $KA/m^2$. The slope or voltage coefficient is 0.157 volts/$KA/m^2$.

The total cell potential versus current density plot or curve in Example 3, shows that the cell voltage points lie on a straight line which, when extrapolated to zero current density, has an intercept on the cell voltage axis of 2.607 volts. The linear equation for the cell voltage of this straight line plot is $2.607+0.181\ i$, where i is the current density expressed in $KA/m^2$. The slope or voltage coefficient is 0.181 volts/$KA/m^2$.

The intercept value on the voltage axis of Examples 1 and 2 are different, reflecting the difference in the cathode activity, and are not equal to the aforementioned decomposition potential of in the range 2.15–2.3 volts. The slopes of the curves are different than if they were plotted between cell voltage intercepts based on the theoretical decomposition potential and actual voltage data points above 1.0 $KA/m^2$, reflecting the differences in the voltages caused by electrolyte concentration gradients across the membranes and electrode overpotentials.

From the Examples it is clear that the cell voltage is best calculated from a voltage coefficient by specifying the value of the constant of the equation since that constant can be different for varying combinations of cell structure, membrane, and cathode. Linearly extrapolating to zero current density the total cell voltage versus current density plot from current densities above 1.0 $KA/m^2$provides the best method for specifying the constant in the cell voltage equation for commercial electrolyzers.

As seen in FIG. 7, at 98° C. the number of moles of water evaporating increases dramatically as more of the IR heat energy in the chlorine gas/anolyte flow streams evaporates water instead of further increasing the temperature of the flow streams. Such rapid evaporation also creates serious problems with disengaging gases from the anolyte. FIG. 8 shows that the voltage coefficient above 0.20 volts per kiloampere per square meter corresponds to a cell operating temperature that exceeds 98° C.

Part of the reason for the lower voltage coefficient is the reduced hardware loss obtained by the cell hardware used in the instant invention. For example, in the alternative embodiment of FIG. 5 where a plate type of electrode is used the voltage drop for the total cell hardware in a cell with 10.0 kiloampere per square meter current density and a total cell load of 15 kiloamperes is calculated to be 92.3 millivolts.

This design calculation is broken out as follows:

| Anode | Voltage Drop (MV) |
|---|---|
| Plate | 18.2 |
| Mesh Support | 11.4 |
| Active Mesh | 31.8 |
| Total | 61.4 |

| Cathode | Voltage Drop (MV) |
|---|---|
| Plate | 18.0 |
| Mesh Supports | 2.3 |
| Active Mesh | 10.6 |
| Total | 30.9 |

The lower the voltage drop, the less resistance encountered by the current as it flows through the cell and, therefore, the lower is the voltage coefficient. Thus, the heat generated will also be less and will contribute less to the needed heat balance to operate the cell at high current densities.

While the preferred structure in which the principles of the present invention have been incorporated is shown and described above, it is to be understood that the invention is not to be limited to the particular details thus presented, but in fact, widely different means may be employed in the practice of the broader aspects of the method of this invention. For example, the cathode can employ a primary active surface or first layer being lanthanum-pentanickel-nickel or utilize coatings on a foraminous metal structure of the first layer metals of Raney-nickel, Raney-nickel-molybdenum, lanthanum-pentanickel, lanthanum nickel or alloys thereof. The scope of the appended claims is intended to encompass all obvious changes in the details, materials and method of utilizing the parts which will occur to one of skill in the art upon a reading of the disclosure.

What is claimed is:

1. In a filter press membrane electrolytic cell having at least one cathode and one anode sandwiched about a permselective ion exchange membrane having a first side adjacent the cathode and a second side adjacent the anode, the improvement comprising in combination:

a. a dual cathode having a first layer and a second layer, the first layer being an active surface cooperative with an immediately adjacent the first side of the membrane and the second layer being a supporting structure for the first layer such that an increased number of electrical current flow paths from the cathode to the membrane are provided; and b. the membrane being surface modified on at least the first side adjacent the cathode so that reduced resistance at the cathode-membrane junction is achieved to permit cell operation at current densities greater than about 4.0 kiloamperes per square meter with a voltage coefficient less than about 0.20 volts per kiloampere per square meter while maintaining a value for the constant in a cell voltage equation equal to the linear extrapolation to zero current density of the slope of the total cell voltage versus current density plot, wherein the cell voltage equation is Vcell=Constant+(Voltage Coefficient)(Current Density).

2. The apparatus according to claim 1 wherein the cathode is a lower overvoltage cathode.

3. The apparatus according to claim 1 wherein the anode is a lower overvoltage anode.

4. The apparatus according to claim 2 wherein the cathode is a low overvoltage cathode with a hydrogen overvoltage of not greater than about 0.3 volts at about 9.5 kiloamperes per square meter.

5. The apparatus according to claim 3 wherein the anode is a low overvoltage anode with a chlorine overvoltage of not greater than about 0.4 volts at about 9.5 kiloamperes per square meter.

6. The apparatus according to claim 1 wherein the voltage coefficient during operation is from about 0.10 to about 0.20 volts per kiloampere per square meter.

7. The apparatus according to claim 1 wherein there is no gap between the first layer of the cathode and the membrane.

8. The apparatus according to claim 1 wherein there is no gap between the anode and the membrane.

9. The apparatus according to claim 1 wherein there is a gap of about 1.0 millimeter or less between the first layer of the cathode and the membrane.

10. The apparatus according to claim 1 wherein the first layer of the cathode is comprised of a first foraminous metal structure from about 0.010 to about 0.045 inches thick.

11. The apparatus according to claim 10 wherein the first foraminous metal structure is selected from the group consisting of nickel, Raney-nickel or Raney-nickel-molybdenum, lanthanum-nickel and lanthanum-pentanickel.

12. The apparatus according to claim 10 wherein the first foraminous metal structure further consists of a coating selected from the group consisting of Raney-nickel, Raney-nickel-molybdenum, lanthanum-pentanickel and lanthanum-nickel.

13. The apparatus according to claim 12 wherein the first foraminous metal structure is a mesh design with a plurality of openings therein.

14. The apparatus according to claim 1 wherein the first layer of the cathode is comprised of a reticulate mat of predetermined thickness.

15. The apparatus according to claim 1 wherein the second layer of the cathode is comprised of a second foraminous metal structure of a thickness greater than the first foraminous metal structure.

16. The apparatus according to claim 15 wherein the second foraminous metal structure is about 0.015 to about 0.045 inches thick.

17. The apparatus according to claim 16 wherein the second foraminous metal structure is of an open mesh design with a plurality of openings therein which are about 0.5 inches by about 1.25 inches.

18. The apparatus according to claim 13 wherein the second foraminous metal structure is of an open mesh design with a plurality of openings therein which are larger than the plurality of openings in the first foraminous metal structure.

19. The apparatus according to claim 1 wherein the second layer of the cathode is comprised of a separator plate of generally rectangular shape having a top and a bottom and a first side and a second side with generally parallel extending support ribs attached to the first side adjacent the first layer of the cathode between the top and the bottom.

20. The apparatus according to claim 19 wherein the second layer further comprises a mesh structure intermediate the support ribs and the first layer.

21. A method of operating a filter press membrane electrolytic cell having at least one cathode and one anode sandwiched about a permselective ion exchange membrane, comprising the steps of a. operating the cell at greater than a 4.0 kiloampere per square meter current density at about one atmosphere pressure;

b. maintaining the cell at a voltage coefficient less than or equal to about 0.20 volts per kiloampere per square meter; and c. maintaining a value for a constant in a cell voltage equation equal to the linear extrapolation to zero current density of the total cell voltage versus current density plot wherein the cell voltage equation is Vcell=Constant+(Voltage Coefficient)(Current Density).

22. The method according to claim 21 further comprising maintaining the anolyte temperature less than or equal to 98° C.

23. The method according to claim 21 further comprising maintaining no gap between the cathode and the membrane.

24. The method according to claim 23 further comprising maintaining no gap between the anode and the membrane.

25. The method according to claim 21 further comprising maintaining a gap of about 1.0 millimeters or less between the cathode and the membrane.

26. The method according to claim 21 further comprising operating the filter press membrane cell with a low overvoltage cathode having a hydrogen overvoltage of not greater than about 0.3 volts at about 9.5 kiloamperes per square meter.

27. The method according to claim 21 further comprising operating the filter press membrane cell with a low overvoltage anode having a chlorine overvoltage of not greater than about 0.4 volts at about 9.5 kiloamperes per square meter.

28. The method according to claim 21 further comprising operating the filter press membrane cell with a cathode having a first layer with an active surface and a second layer supporting the first layer.

* * * * *